United States Patent [19]

Murasaki et al.

[11] Patent Number: 5,038,729

[45] Date of Patent: Aug. 13, 1991

[54] DISTRIBUTOR DRIVING APPARATUS FOR ENGINES

[75] Inventors: Akira Murasaki, Yokohama; Masayuki Hashimoto, Kanagawa, both of Japan

[73] Assignees: Nissan Motor Co., Ltd., Yokohama; Nissan Kohki Co., Ltd., Kanagawa, both of Japan

[21] Appl. No.: 433,274

[22] Filed: Nov. 8, 1989

[30] Foreign Application Priority Data

Nov. 11, 1988 [JP] Japan ..... 63-147189[U]

[51] Int. Cl.[5] ..... F01L 1/04; F02P 7/10

[52] U.S. Cl. ..... 123/146.5 A; 123/90.31

[58] Field of Search ..... 123/90.27, 90.31, 146.5 A

[56] References Cited

U.S. PATENT DOCUMENTS

| | | | |
|---|---|---|---|
| 4,007,723 | 2/1977 | Laughton | 123/146.5 A |
| 4,305,352 | 12/1981 | Oshima et al. | 123/146.5 A X |
| 4,750,455 | 6/1988 | Ebesu | 123/90.27 X |
| 4,753,199 | 6/1988 | Melde-Tuczai et al. | 123/90.31 |

FOREIGN PATENT DOCUMENTS

| | | | |
|---|---|---|---|
| 60-58874 | 4/1985 | Japan . | |
| 0032203 | 2/1987 | Japan | 123/90.31 |

*Primary Examiner*—Willis R. Wolfe

*Attorney, Agent, or Firm*—Foley & Lardner

[57] ABSTRACT

To improve ignition timing precision without being subjected to a harmful influence of gear backlash produced when the distributor unit is directly driven by a camshaft and further to mount the distributor unit on the front cover at any desired inclination angle for reduction of total engine height, the distributor driving apparatus for an DOHC engine, in particular comprises two camshaft sprockets fixed to two camshafts; an idler sprocket rotatably supported between the two camshafts and the crankshaft; a first chain reeved around the crankshaft and the idler sprocket; a second chain reeved around the idler sprocket and the two camshaft sprockets; and a distributor driving gear fixed to the idler sprocket. Therefore, when the crankshaft is rotated, the idler sprocket is driven by the crankshaft via the first chain and therefore the distributor unit is directly driven by the distributor driving gear. On the other hand, the camshaft sprockets are driven by the idler sprocket via the second chain.

2 Claims, 5 Drawing Sheets

6

DISTRIBUTOR DRIVING APPARATUS FOR ENGINES

BACKGROUND OF THE INVENTION

1. Field of the Invention

The present invention relates generally to a distributor driving apparatus for an engine.

2. Description of the Prior Art

To obtain higher engine performance in automotive vehicles, DOHC (double overhead camshaft) engines have been widely used, in which two different camshafts for driving intake and exhaust valves separately are provided on a cylinder head. In the prior-art DOHC engines, however, since the distributor is driven by one of the camshafts by engaging a driving gear fixed to a front end of the camshaft with a driven gear fixed to the distributor, there exist various problems in that the gear arrangement positions and the distributor inclination angle are restricted and therefore the distributor projects beyond the engine rocker cover, thus increasing the engine total height.

Further, since the distributor driving gear is fixed to either one of the two camshafts, there exists another problem in that the two camshafts cannot be used in common and therefore additional machining process is required, thus decreasing the productivity of the engine. Furthermore, since the distributor is directly driven by the camshaft in gear-to-gear engagement relationship, the revolution of the distributor is subjected to the harmful influence of backlash of the gear fixed to the camshaft whose rotative speed tends to fluctuate, thus deteriorating ignition timing precision. To overcome this backlash problem, Japanese Published Unexamined (Kokai) Utility Model Application 60-58874 discloses a distributor driving gear apparatus whose teeth are alternately magnetized into N and S poles, for instance.

SUMMARY OF THE INVENTION

With these problems in mind, therefore, it is the primary object of the present invention to provide a distributor driving apparatus for an engine, by which the ignition timing precision can be improved without being subjected to a harmful influence of camshaft gear backlash and further the distributor unit can be mounted on an engine front cover at any desired inclination angle for reduction of total engine height.

To achieve the above-mentioned object, a distributor driving apparatus for an engine having at least one camshaft mounted on a cylinder head and a crankshaft, according to the present invention, comprises: (a) at least one camshaft sprocket (51) coaxially coupled to the at least one camshaft; (b) an idler sprocket (60) rotatably supported between the camshaft and the crankshaft and on the cylinder head; (c) a first chain (68) reeved around said crankshaft and said idler sprocket to rotate said idler sprocket by said crankshaft; (d) a second chain (69) reeved around said idler sprocket and the camshaft sprocket to rotate said camshaft sprocket by said idler sprocket; (e) a distributor driving gear (61) coaxiallry coupled to said idler sprocket; and (f) a distributor unit (40) including a distributor driven gear (43) in mesh with said distributor driving gear to ignite the engine when said idler sprocket is rotated by the crankshaft via said first chain.

The idler sprocket (60) is formed with a first sprocket wheel (60A) engaged with the first chain and a second sprocket wheel (60B) engaged with the second chain.

Further, a front cover for covering the idler sprocket and supporting the distributor unit is formed with an inclined boss portion (31) to which, the distributor unit is fixed by passing the distributor driven gear through the boss portion into mesh with the distributor driving gear.

In the above-mentioned construction, since the distributor unit is directly driven by the crankshaft via the idler sprocket, it is possible to eliminate the harmful influence of backlash of gears attached to the camshafts, thus improving the precision of ignition timing. Further, since the distributor driving gear is arranged on the front end of the idler sprocket and therefore the driven gear of the distributor unit is disposed remote from the front end of cylinder head, it is possible to mount the distributor unit on the front cover for covering the distributor at any desired inclination angle, thus decreasing the total engine height. Further, in the case of DOHC engines, it is possible to use the two camshafts in common, thus improving the engine productivety.

DETAILED DESCRIPTION OF THE PREFERRED EMBODIMENTS

Embodiments of the distributor driving apparatus according to the present invention will be described in detail with reference to the attached drawings by taking the case where the present invention is applied to a DOHC engine.

Figure 1:
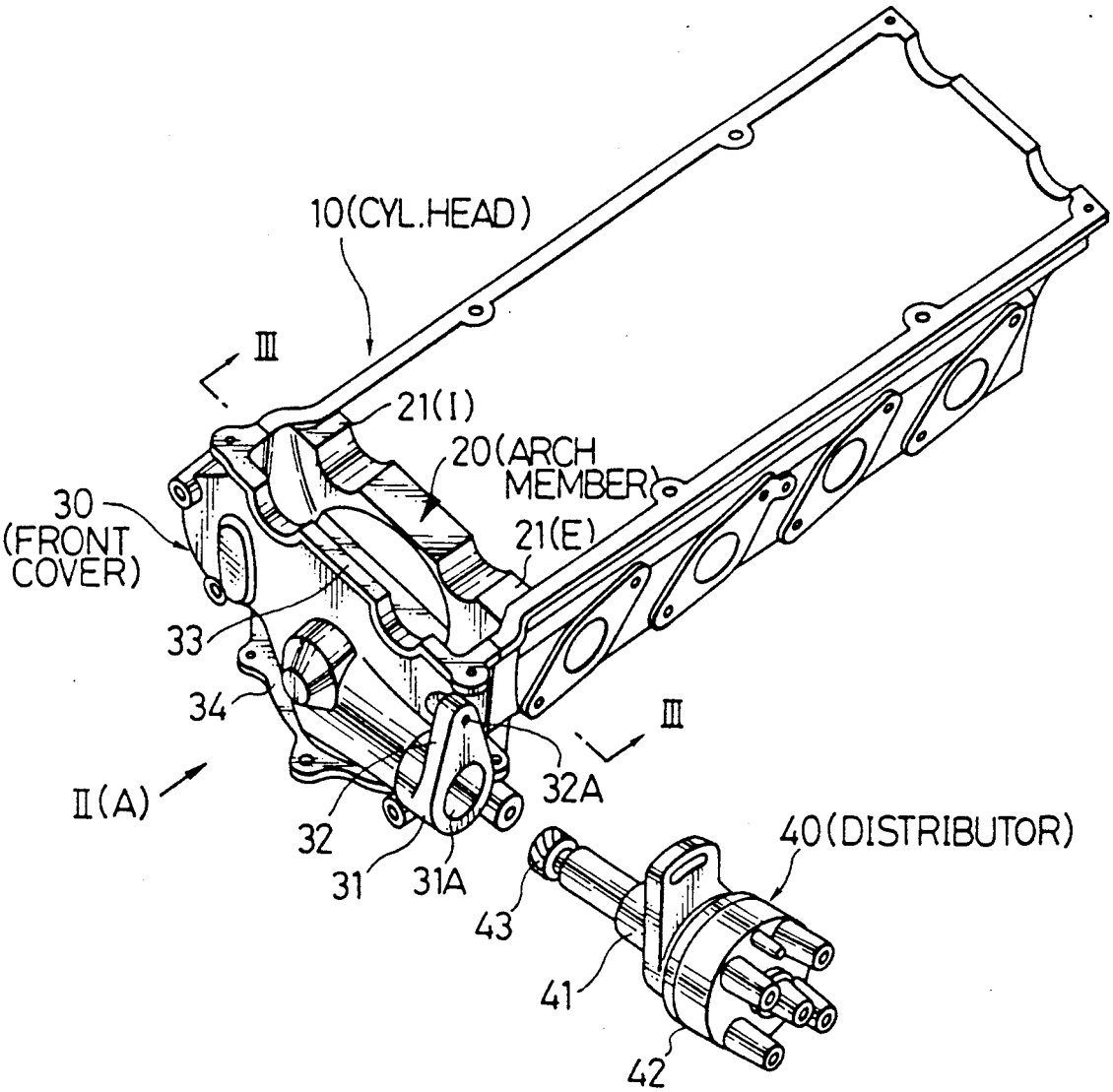
FIG. 1 is a perspective, partially exploded view for assistance in explaining a cylinder head, a front cover, a distributor unit, etc., to which the distributor driving apparatus according to the present invention is mounted.

FIG. 1 shows a cylinder head 10, an arch member 20 formed integral with the cylinder head 10 to support intake and exhaust camshafts, a front cover 30 attached to a front side of the cylinder head 10, and a distributor unit 40.

As shown in FIG. 1, the arch member 20 is formed with an intake camshaft bearing portion 21(I) and an exhaust camshaft bearing portion 21(E).

Figure 2A:
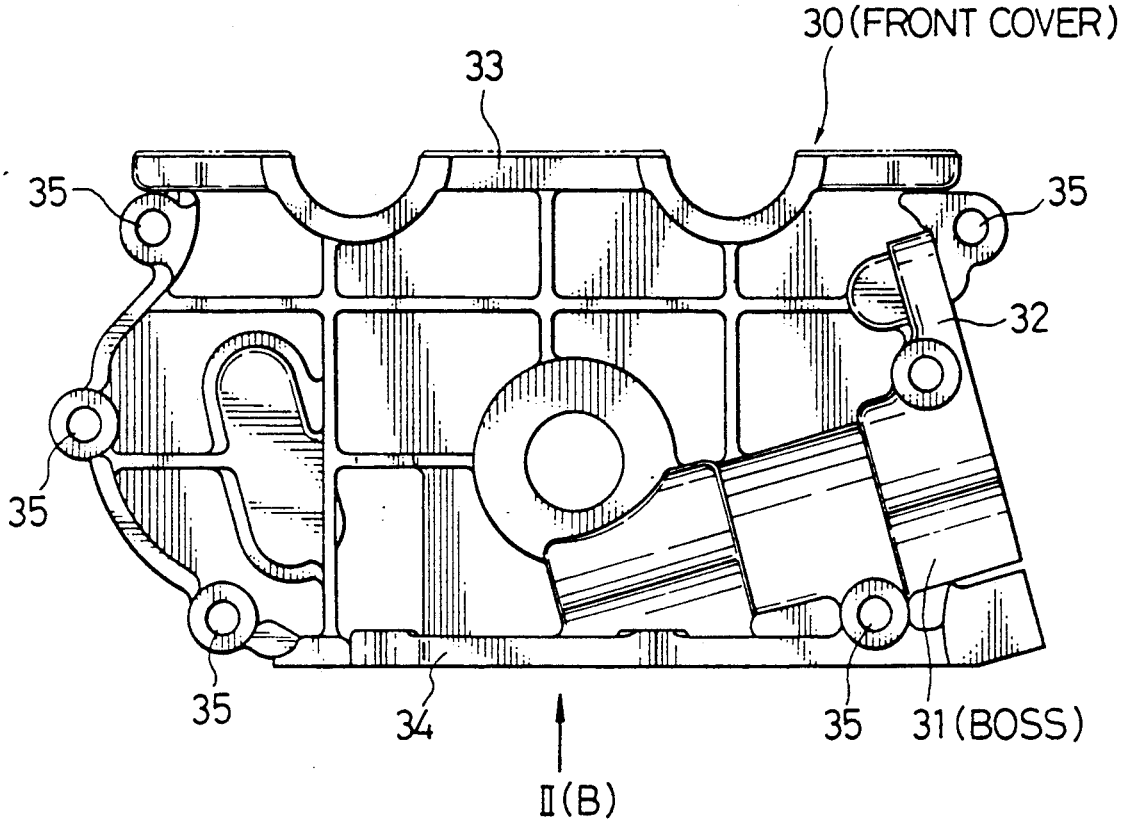
FIG. 2(A) is a front view showing a front cover when seen from the line II(A)—II(A) in FIG. 1.
Figure 2B:
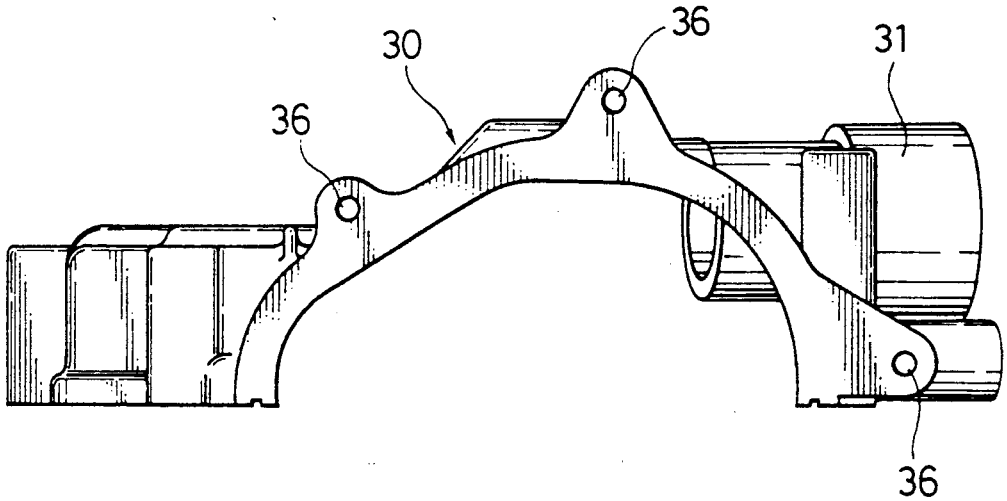
FIG. 2(B) is a bottom view showing the front cover when seem from the line II(B)—II(B) in FIG. 2(A)

With reference to further FIGS. 2(A) and 2(B), the front cover 30 is formed with a boss portion 31 and a distributor joint flange portion 32 both for supporting the distributor unit 40, a rocker cover joint flange portion 33 fixed to a rocker cover, a cylinder block side front cover joint flange portion 34 fixed to the cylinder block side front cover (not shown), a plurality of bolt holes 35 for fixing the front cover 30 to the cylinder head 10, and a plurality of bolt holes 36 for fixing the front cover 30 to the cylinder block side front cover (not shown).

The distributor unit 40 includes a distributor housing 41, a distributor cap 42, and a helical distributor driven gear 43. Within the distributor cap 42, various ignitor elements such as an ignition coil, high tension cables connected to ignition plugs, etc. (all not shown) are arranged.

To fix the distributor unit 40 to the front cover 30, the helical distributor driven gear 43 is inserted into a central hole 31A of the boss portion 31 and the distributor housing 41 is fixed to the joint flange portion 32 by screwing a bolt (not shown) into a threaded hole 32A. As depicted in FIG. 2(A), the boss portion 31 of the front cover 30 is formed so as to project at an inclination angle with respect to the horizontal line, with the result that the distributor unit 40 is fixed to the front cover 30 at an inclination angle so that the cap 42 is directed upward.

Figure 3:
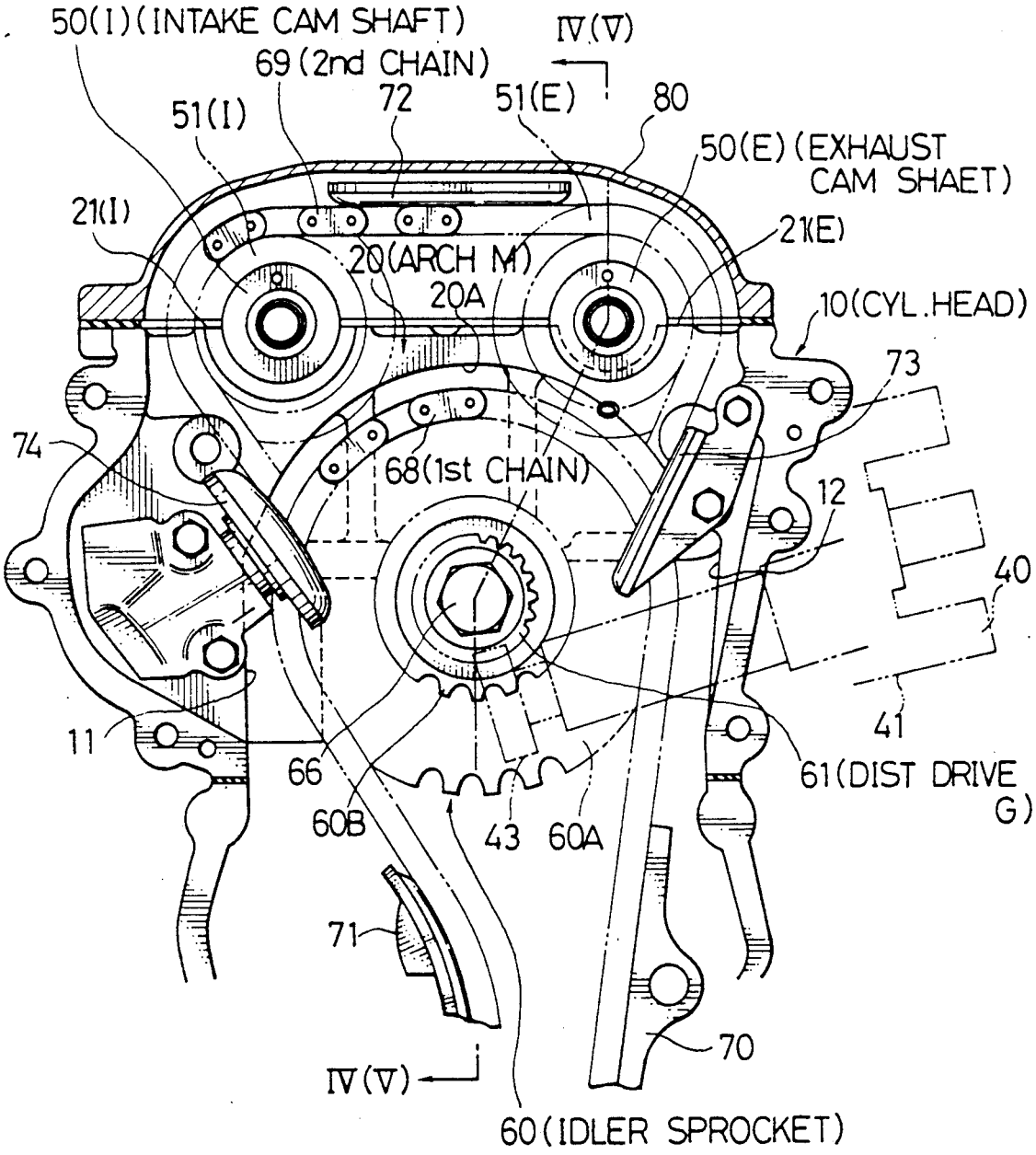
FIG. 3 is a front view for assistance in explaining the distributor driving apparatus according to the present invention when seem from the line III—III in FIG. 1.
Figure 4:
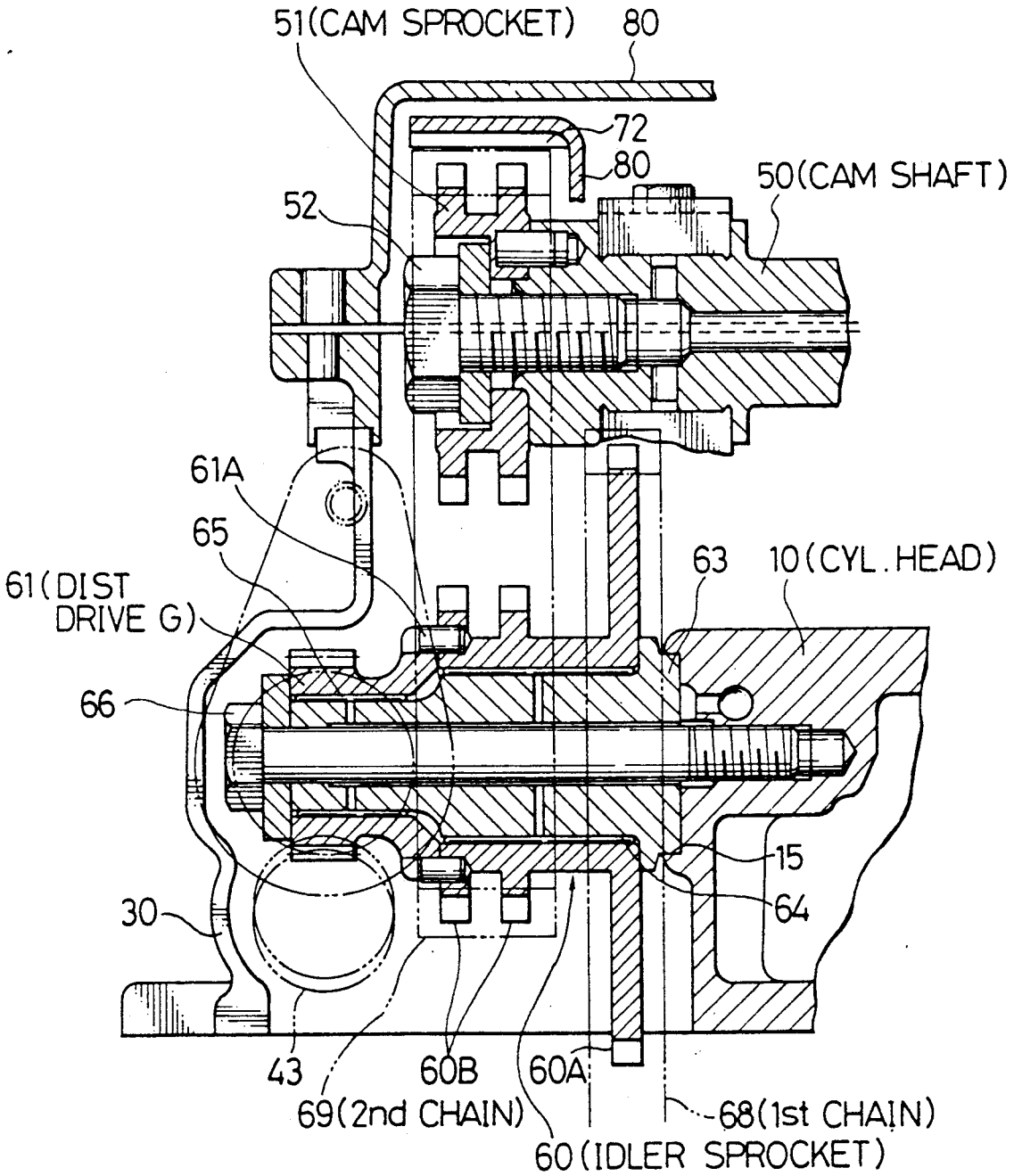
FIG. 4 is a cross-sectional view taken along the line IV—IV in FIG. 3.

With reference to FIGS. 3 and 4, the distributor driving apparatus according to the present invention will be described in detail hereinbelow, which is incorporated between the cylinder head 10 and the front cover 30. An idler sprocket 60 is provided between two camshafts 50 and a crankshaft, and driven by the crankshaft via a first chain 68; the two camshafts 50 are driven by the idler sprocket 60 via a second chain 69; and the distributor unit 40 is driven by a distributor driving gear 61 fixed to the idler sprocket 60. In addition, the distributor unit 40 is mounted on the front cover 30 for covering the idler sprocket 60 at any desired inclination angle.

An intake camshaft 50(I) is supported at the intake camshaft bearing portion 21(I) of the arch member 20 formed integral with the cylinder head 10. An exhaust camshaft 50(E) is supported at the exhaust camshaft bearing portion 21(E) of the same arch member 20. Intake valves (not shown) are driven open or closed by the intake camshaft 50(I) and exhaust valves (not shown) are driven open or closed by the exhaust camshaft 50(E). An intake camshaft sprocket 51(I) having two sprocket wheels is fixed to the intake camshaft 50(I) by a bolt 52(I) and similarly an exhaust camshaft sprocket 51(E) having two sprocket wheels is fixed to the exhaust camshaft 50(E) by a bolt 52(E).

Under the two camshafts 50(I) and, 50(E), the idler sprocket 60 and the helical distributor driving gear 61 fixed to the idler sprocket 60 are rotatably supported by an idler shaft 63 (fitted to a recess 15 formed in the cylinder head 10) via two bearing (bush) members 64 and 65, respectively. The idler sprocket 60, the helical distributor driving gear 61 and the idler shaft 63 are all mounted together to the cylinder head 10 with a bolt 66. The idler sprocket 60 is formed with a first sprocket (large diameter) chain wheel 60A and two second sprocket (small diameter) chain wheels 60B. In this first embodiment shown in FIG. 4, the helical distributor driving gear 61 is fixed to the idler sprocket 60 with two pins 61A. The helical distributor driving gear 61 is engaged with the helical distributor driven gear 43. The helical driven gear 43 rotates at a rotative speed half of the crankshaft.

The first sprocket chain wheel 60A is driven by a crankshaft (not shown), because a first chain 68 is reeved around a crankshaft chain wheel (not shown) and the first sprocket chain wheel 60A. Further, the two intake and exhaust camshaft sprockets 51(I) and 51(E) are driven by the idler sprocket 60 in synchronism with the crankshaft, because a second chain 69 is reeved around the two second sprocket chain wheels 60B and the two sprocket wheels 51 of each of the intake and exhaust camshafts 50(I) and 50(E).

As shown in FIG. 3, the first chain 68 is guided by a first chain guide 70, and an appropriate tension is applied to the first chain 68 by a first chain tensioner 71. In the same way, the second chain 69 is guided by two second chain guides 72 and 73, and an appropriate tension is applied to the second chain 69 by a second chain tension 74. Further, the first chain 68 is arranged under the arch member 20 near and along an inner arcuate wall surface 20A thereof formed so as to extend from the two inner side surfaces 11 and 12 of the cylinder head 10.

Further, as shown in FIG. 1, the front cover 30 is fixed to the front end surface of the cylinder head 10 with bolts, and further a rocker cover 80 is fixed to the upper end surface of the cylinder head 10 and the front cover 30.

Figure 5:
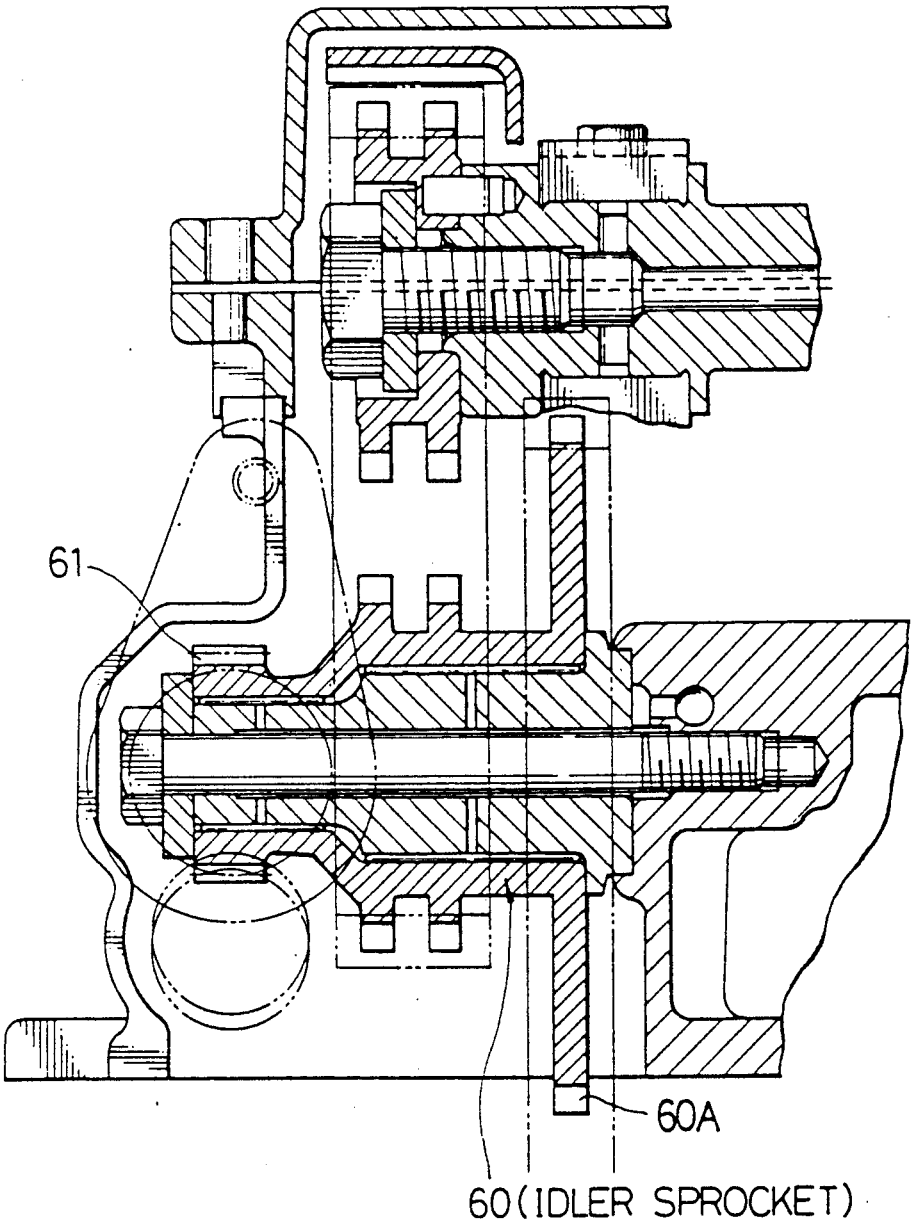
FIG. 5 is a similar cross-sectional view for assistance in explaining a second embodiment of the present invention.

FIG. 5 shows a second embodiment of the present invention, in which the helical distributor driving gear 61 is formed integral with the idler sprocket 60 without use of the pins 61A (shown in FIG. 4). Structual features and functional effects of the second embodiment other than those described above are substantially the same as is the case with the first embodiment previously described and any detailed description of them is believed to be unnecessary.

In operation, when the engine is running, since the crankshaft (not shown) is rotated, the idler sprocket 60 is driven by the crankshaft via the first chain 68, so that the intake and exhaust camshaft sprockets 51(I) and 51(E) are driven by the idler sprocket 60 via the second chain 69 to open and close intake and exhaust valves at proper timing. On the other hand, since the helical distributor driving gear 61 is fixed to the idler sprocket 60, the distributor unit 40 is driven by the helical distributor driven gear 43 in mesh with the helical distributor driving gear 61, so that ignition plugs provided for engine cylinders are ignited in sequence by a high tension (volt) generated by the distributor unit 40 driven as described above.

In the apparatus according to the present invention, since the distributor unit 40 is driven by the idler sprocket 60 without being driven by the camshaft 50(I) or 50(E) as is conventional, that is, without being subjected to the harmful influence of backlash of a gear attached to the camshaft which tends to fluctuate in speed, it is possible to ignite the engine at accurate ignition timing.

Further, since the distributor unit 40 is indirectly driven by the idler sprocket 60, it is possible to mount the distributor unit 40 on the front cover 30 at any desired inclination angle, without projecting the distributor unit 40 beyond the rocker cover 80, thus decreasing the total height of the engine.

As described above, in the distributor driving apparatus according to the present invention, since the idler sprocket is rotatably disposed in position between the crankshaft and the camshaft (or camshafts) and further a distributor driving gear is fixed to or formed integral with the idler sprocket without being directly driven by the camshaft (i.e. without being subjected to the influence of gear backlash), it is possible to improve the ignition timing precision. Further, since the distributor unit can be mounted on the front cover at any desired inclination angle, it is possible to prevent the distributor unit from projecting from the cylinder head (the total engine height can be reduced). Further, in the case of DOHC engines, since two camshafts can be used in common, it is possible to increase the engine productivity.

What is claimed is:

1. A distributor driving apparatus for an engine having at least one camshaft mounted on a cylinder head and a crankshaft, comprising:

(a) at least one camshaft sprocket coaxially coupled to the at least one camshaft;

(b) an idler sprocket rotatably supported between the camshaft and the crankshaft and on the cylinder head and formed with a first sprocket wheel and a second sprocket wheel;

(c) a first chain reeved around said crankshaft and the first sprocket wheel of said idler sprocket to rotate said idler sprocket by said crankshaft;

(d) a second chain reeved around the second sprocket wheel of said idler sprocket and the camshaft sprocket to rotate said camshaft sprocket by said idler sprocket;

(e) a distributor driving gear coaxially coupled to said idler sprocket;

(f) a distributor unit including a distributor driven gear in mesh with said distributor driving gear to ignite the engine when said idler sprocket is rotated by the crankshaft via said first chain; and (g) a front cover for covering said idler sprocket and further supporting said distributor unit.

2. The distributor driving apparatus for an engine of claim 1, wherein said front cover is formed with an inclined boss portion to which said distributor unit is fixed with the distributor driven gear passed through said boss portion into mesh with the distributor driving gear.

* * * * *